US008220880B1

(12) United States Patent
Lin

(10) Patent No.: US 8,220,880 B1
(45) Date of Patent: Jul. 17, 2012

(54) ADJUSTABLE DRESSING MIRROR ASSEMBLY

(76) Inventor: Chen-Chieh Lin, Taichung (TW)

( * ) Notice: Subject to any disclaimer, the term of this patent is extended or adjusted under 35 U.S.C. 154(b) by 0 days.

(21) Appl. No.: 13/115,852

(22) Filed: May 25, 2011

(51) Int. Cl.
*A47G 1/00* (2006.01)
*A47B 67/00* (2006.01)

(52) U.S. Cl. ..... 312/227; 248/474

(58) Field of Classification Search ..... 312/224–226; 359/838–883; 248/466, 469, 474; D6/300, D6/310, 312
See application file for complete search history.

(56) References Cited

U.S. PATENT DOCUMENTS

| | | | | |
|---|---|---|---|---|
| 3,774,247 | A * | 11/1973 | Bradley | 5/53.2 |
| D329,753 | S * | 9/1992 | Delafield | D6/311 |
| 5,681,100 | A * | 10/1997 | Powell | 312/227 |
| 7,600,879 | B1 * | 10/2009 | Reynolds | 359/881 |
| 2002/0033436 | A1 * | 3/2002 | Peng et al. | 248/284.1 |

FOREIGN PATENT DOCUMENTS

| | | | |
|---|---|---|---|
| CN | 201948538 U | * | 8/2011 |
| CN | 202086117 U | * | 12/2011 |

* cited by examiner

*Primary Examiner* — Mark Consilvio
(74) *Attorney, Agent, or Firm* — Ladas & Parry, LLP

(57) ABSTRACT

An adjustable dressing mirror assembly includes a support, a rear link connected pivotally to the support, a mirror-mounting unit having an upper end pivotable forwardly and rearwardly relative to the support, a front link connected pivotally to the mirror-mounting unit and the rear link, and a positioning device. The positioning device includes: a plurality of positioning groove units formed in one of the front and rear links; a swing arm having a pivot end connected pivotally to the other one of the front and rear links, and an engaging end opposite to the pivot end; an engaging member disposed on the engaging end of the swing arm such that, by rotating the mirror-mounting unit, the engaging member is movable to engage within a selected one of the positioning groove units; and a resilient member for biasing the engaging member into the selected one of the positioning groove units.

6 Claims, 12 Drawing Sheets

ADJUSTABLE DRESSING MIRROR ASSEMBLY

BACKGROUND OF THE INVENTION

1. Field of the Invention

This invention relates to a mirror, and more particularly to an adjustable dressing mirror assembly.

2. Description of the Related Art

Referring to FIG. 1, a conventional adjustable dressing mirror assembly 10 includes a support 11, a mirror frame 13 disposed pivotally on the support 11 by two pivot members 12, and a mirror 14 disposed fixedly within the mirror frame 13.

The mirror frame 13 is rotatable about the pivot members 12 to adjust the inclination angle of the mirror 14. However, when the mirror 14 is adjusted to a desired angle, the desired angle cannot be maintained. For example, when an external force is applied accidentally to the mirror frame 13, the inclination angle of the mirror 14 may be changed, thereby requiring readjustment to result in inconvenience during use of the dressing mirror assembly 10.

SUMMARY OF THE INVENTION

The object of this invention is to provide a dressing mirror assembly that includes a mirror adjustable to an desired angle and capable of being maintained at the desired angle.

Accordingly, an adjustable dressing mirror assembly of this invention includes a support, a rear link connected pivotally to the support, a mirror-mounting unit having an upper end pivotable forwardly and rearwardly relative to the support, a front link connected pivotally to the mirror-mounting unit and the rear link, and a positioning device. The positioning device includes: a plurality of positioning groove units formed in one of the front and rear links; a swing arm having a pivot end connected pivotally to the other one of the front and rear links, and an engaging end opposite to the pivot end; an engaging member disposed on the engaging end of the swing arm such that, by rotating the mirror-mounting unit, the engaging member is movable to engage within a selected one of the positioning groove units; and a resilient member for biasing the engaging member into the selected one of the positioning groove units so as to maintain the mirror-mounting unit at a desired inclination angle.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
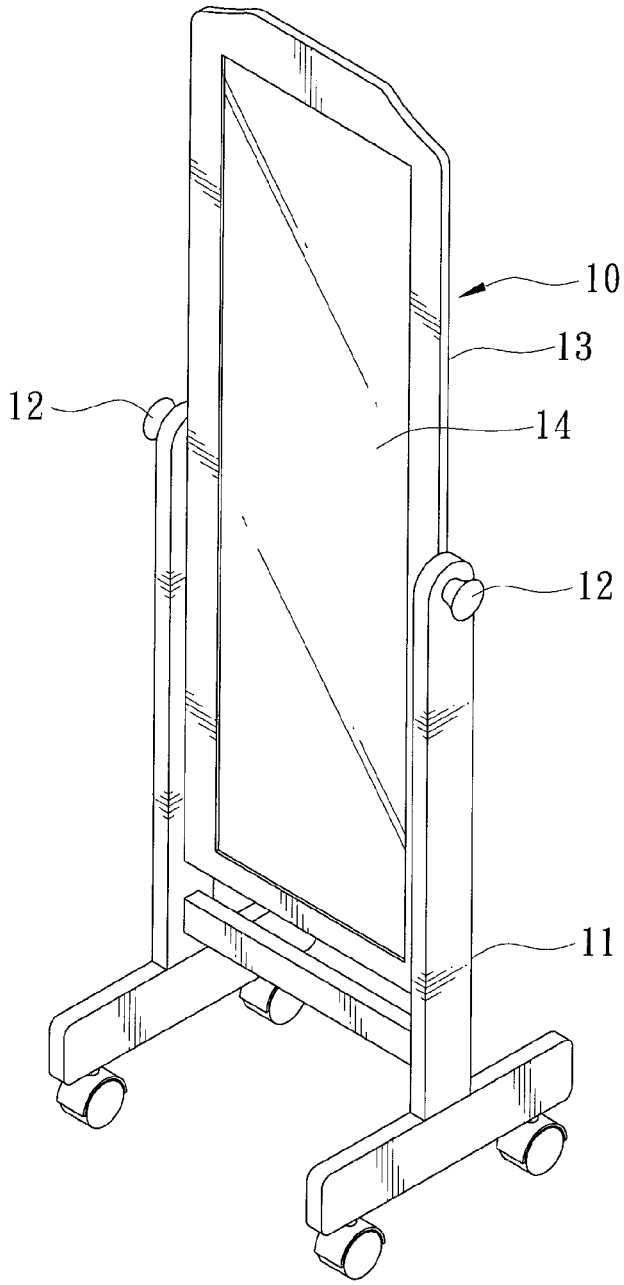
FIG. 1 PRIOR ART
FIG. 1 is a perspective view of a conventional adjustable dressing mirror assembly.
Figure 2:
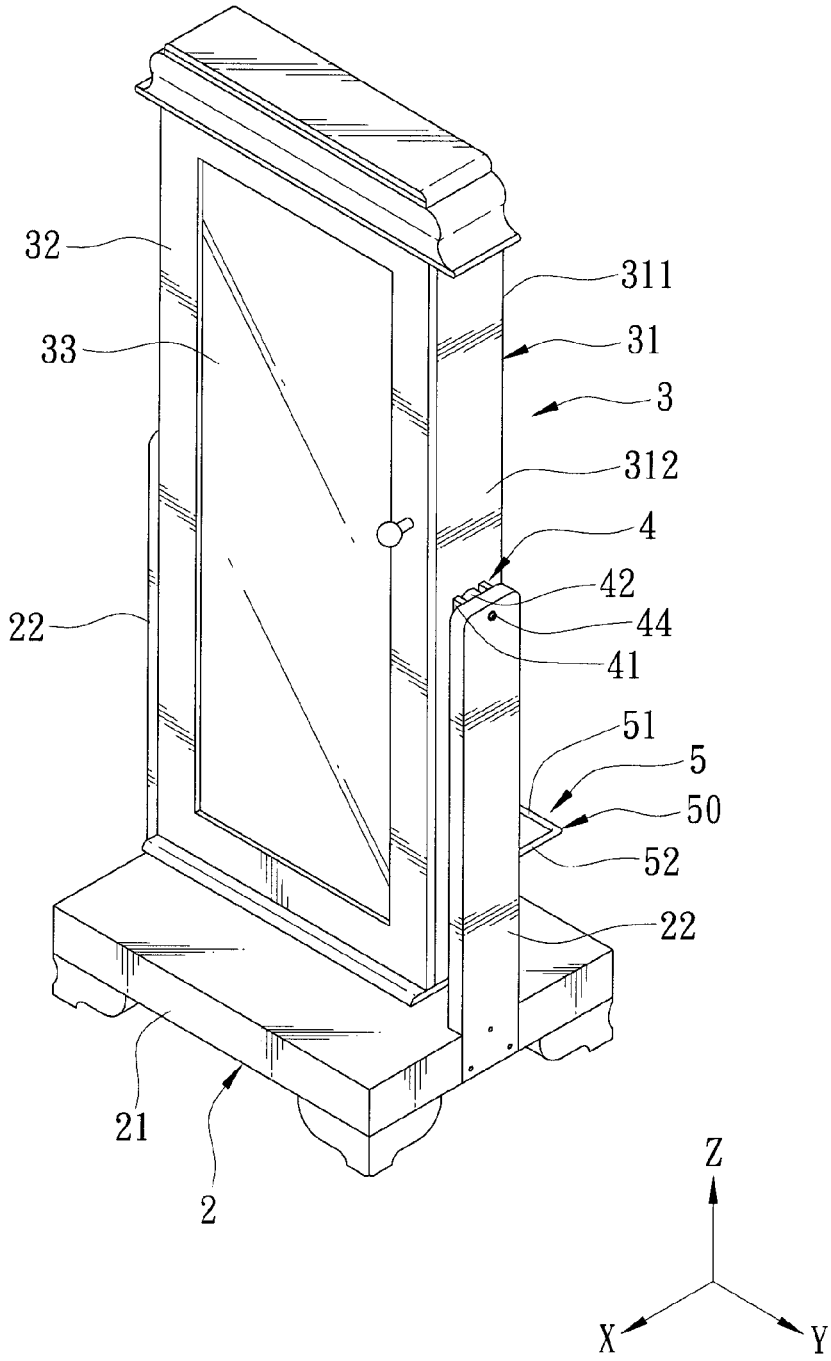
FIG. 2 is a perspective view of the preferred embodiment of an adjustable dressing mirror assembly according to this invention.
Figure 3:
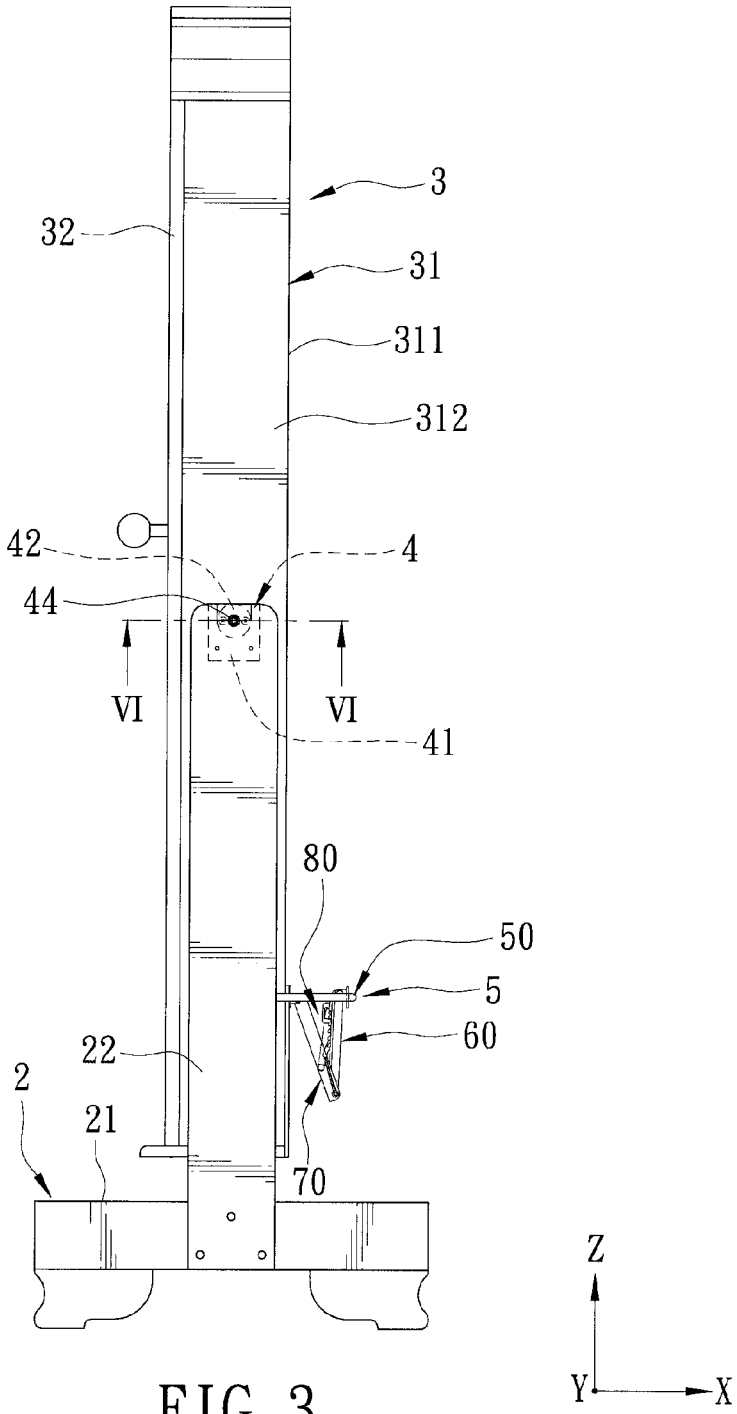
FIG. 3 is a side view of the preferred embodiment, illustrating a vertical position of a mirror-mounting unit.

Referring to FIGS. 2 and 3, the preferred embodiment of an adjustable dressing mirror assembly according to this invention includes a support 2, a mirror-mounting unit 3, two pivotal connection units 4, and an adjusting mechanism 5.

The support 2 includes a base 21 and two upright rods 22 disposed fixedly on and above the base 21.

The mirror-mounting unit 3 includes a storage cabin housing 31, and a door plate 32 disposed pivotally on the storage cabin housing 31 and permitting a mirror 33 to be mounted thereon. The storage cabin housing 31 includes a back plate 311 and two side plates 312.

Figure 5:
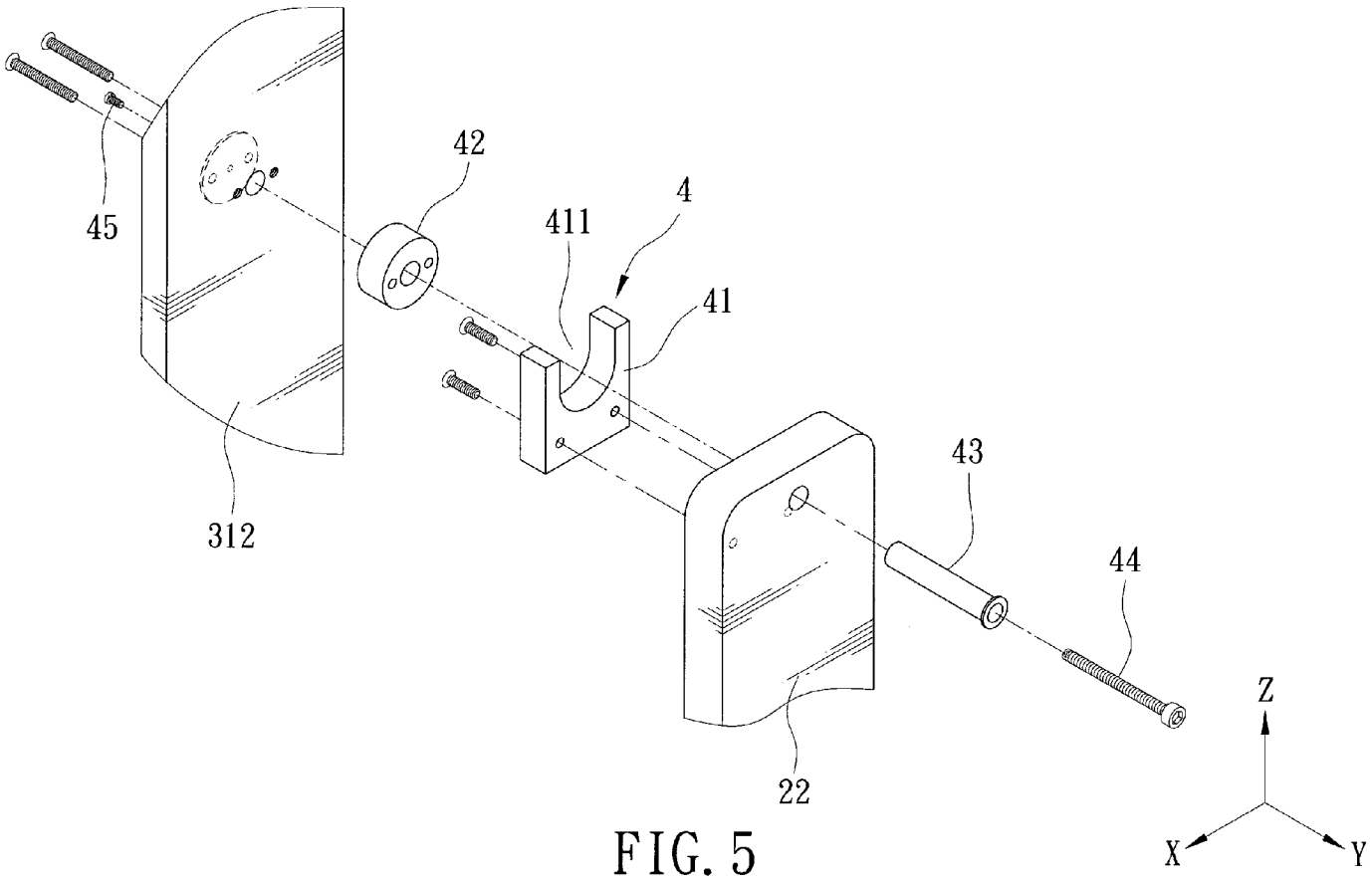
FIG. 5 is a fragmentary exploded perspective view of the preferred embodiment, illustrating a pivotal connection unit.
Figure 6:
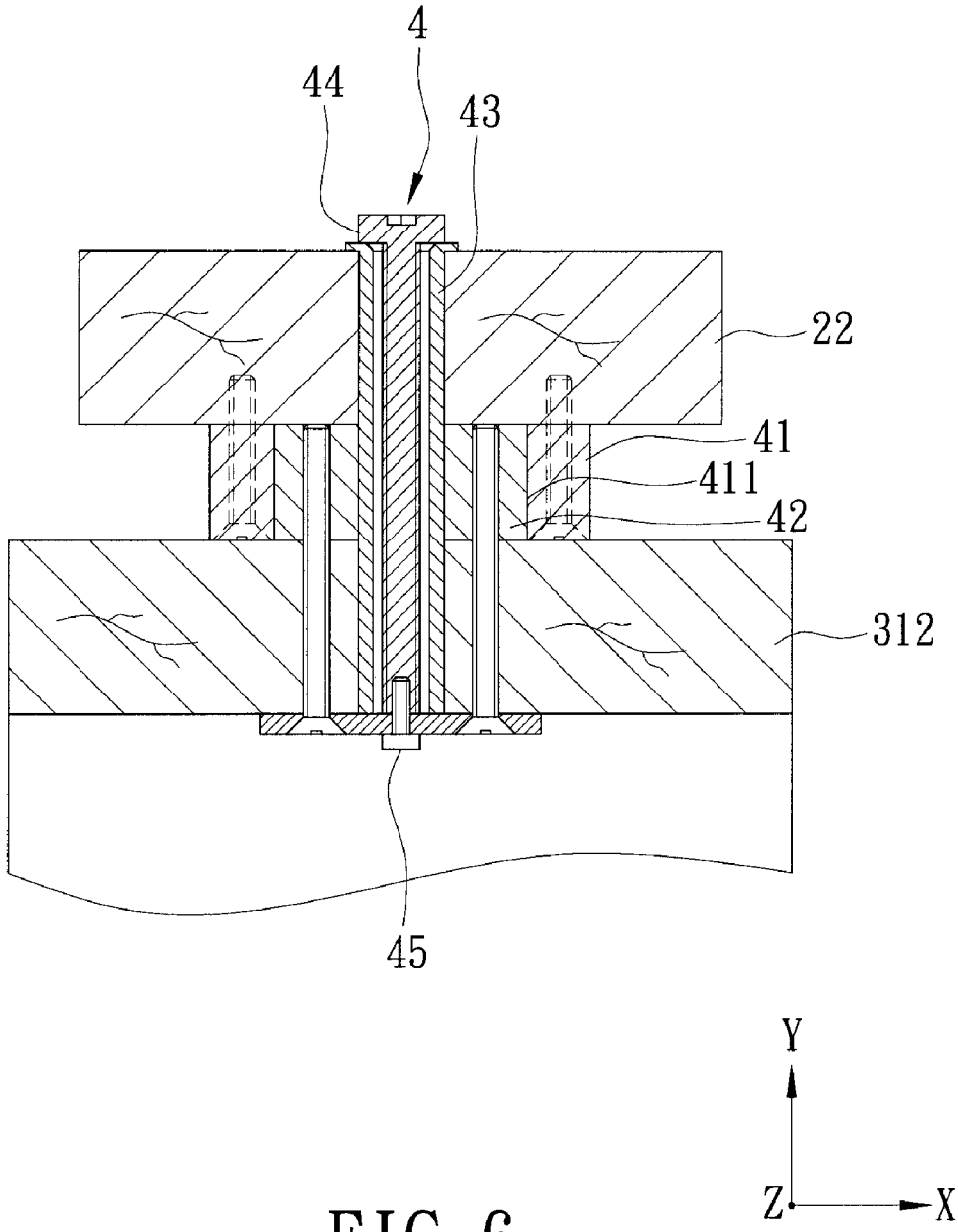
FIG. 6 is a sectional view taken along line VI-VI in FIG. 3.

With additional reference to FIGS. 5 and 6, each of the upright rods 22 is connected to an adjacent one of the side plates 312 by a respective one of the pivotal connection units 4. Each of the pivotal connection units 4 includes a support seat 41 disposed fixedly on the corresponding upright rod 22, a cylindrical rotating block 42 disposed fixedly on the corresponding side plate 312, a sleeve 43 extending through the corresponding upright rod 22 and the rotating block 42 along a left-to-right direction (Y), a first bolt 44 extending through the sleeve 43, and a second bolt 44 threaded to the first bolt 44. The heads of the first and second bolts 44, 45 abut respectively against two end surfaces of the sleeve 43. The support seat 41 is formed with a curved groove 411. The cylindrical rotating block 42 is received rotatably within the curved groove 411 in the support seat 41.

As such, the mirror-mounting unit 3 is disposed rotatably between the upright rods 22 of the support 2 in such a manner to allow for forward and rearward pivoting movement of an upper end of the mirror-mounting unit 3 relative to the support 2.

Figure 7:
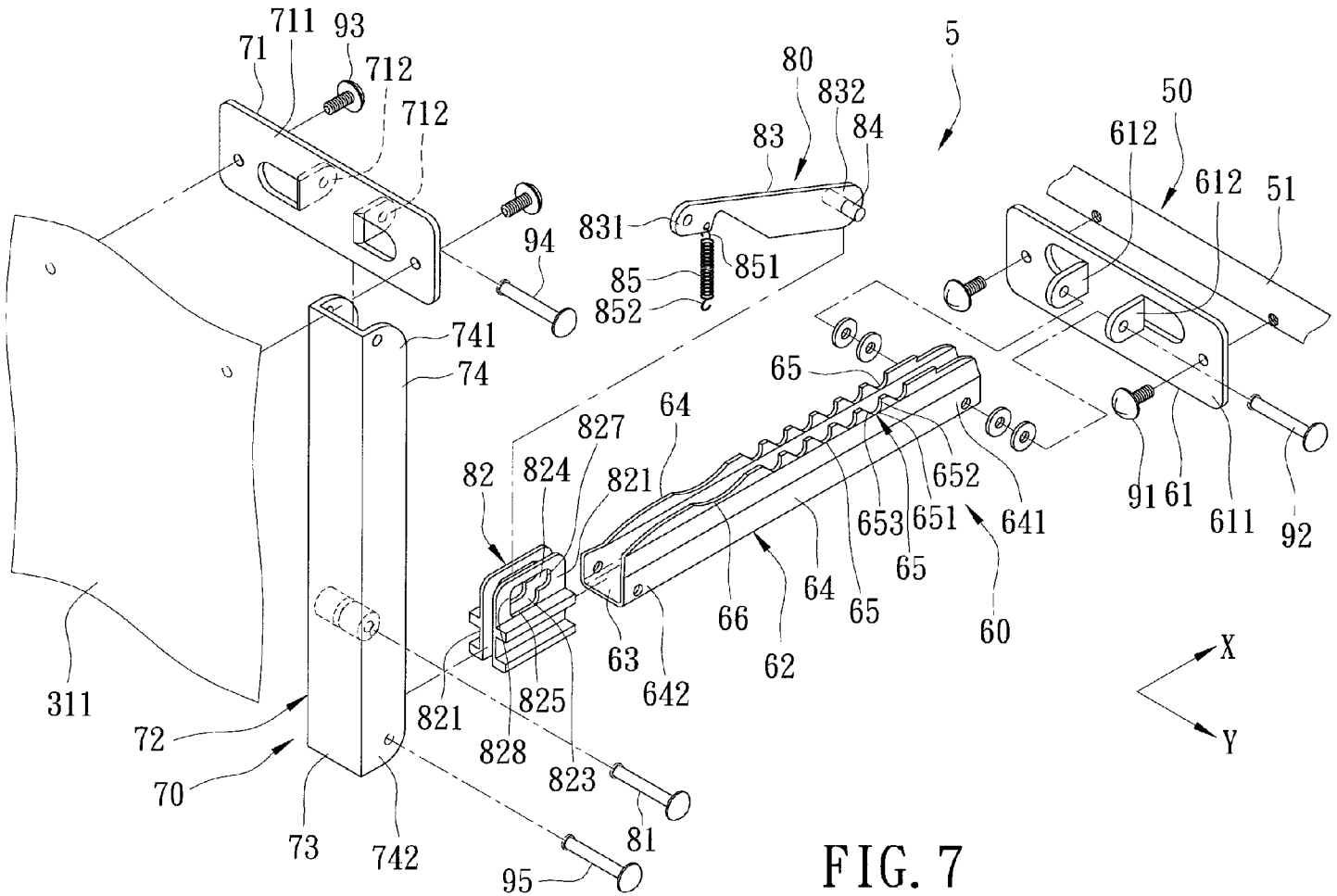
FIG. 7 is a fragmentary exploded perspective view of the preferred embodiment, illustrating a positioning device.

With further reference to FIG. 7, the adjusting mechanism 5 includes a mounting frame 50, a rear linking unit 60, a front linking unit 70, and a positioning unit 80.

The mounting frame 50 includes a first rod 51 extending along the left-to-right direction (Y), and two second rods 52 extending respectively and perpendicularly from two opposite ends of the first rod 51 along a front-to-rear direction (X).

Figure 8:
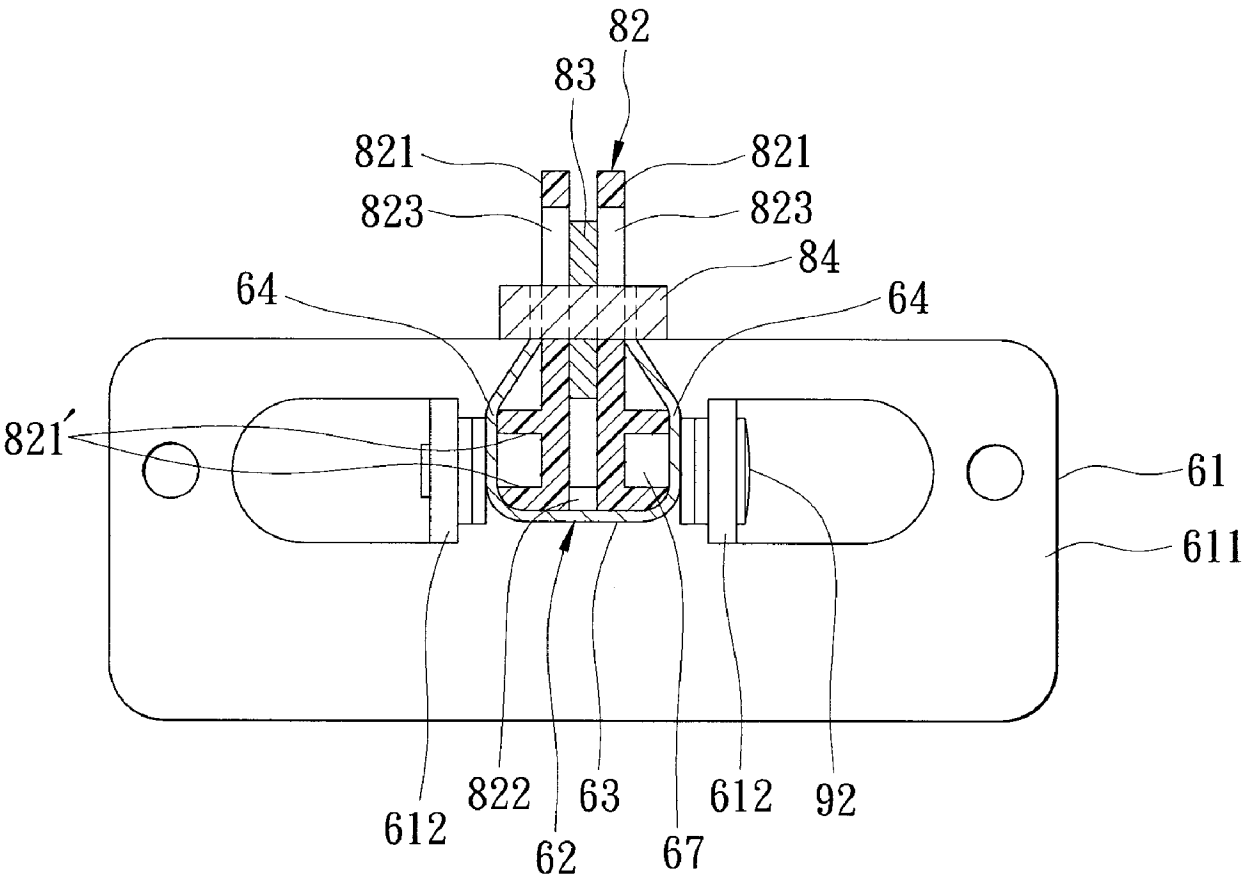
FIG. 8 is a fragmentary sectional view of the preferred embodiment, illustrating that a sliding member is confined within a dovetail groove in the rear link so as to prevent upward removal of the sliding member from the rear link.

With further reference to FIG. 8, the rear linking unit 60 includes a first pivot seat 61 mounted to the first rod 51, and a rear link 62 connected pivotally to the first pivot seat 61.

The first pivot seat 61 includes a fixed upright plate 611 fastened to the first rod 51 by two lock bolts 91, and two parallel pivot lugs 612 extending forwardly from the fixed upright plate 611.

The rear link 62 includes a bottom wall 63 and two sidewalls 64 respectively from two opposite sides of the bottom wall 63 and aligned with each other along the left-to-right direction (Y). Each of the sidewalls 64 is serrated, and has a plurality of positioning grooves 65 arranged along the front-to-rear direction (X), and a curved groove 66 aligned with the positioning grooves 65 along the front-to-rear direction (X). The positioning grooves 65 in one of the sidewalls 64 are aligned respectively with the positioning grooves 65 in the other one of the sidewalls 64 along the left-to-right direction (Y), so that each of the positioning grooves 65 in each of the sidewalls 64 cooperates with an aligned one of the positioning grooves 65 in the other one of the sidewalls 64 to constitute a positioning groove unit.

The distance between the sidewalls 64 reduces in a direction away from the bottom wall 63, such that a dovetail groove 67 (see FIG. 8) is defined among the bottom wall 63 and the sidewalls 64.

Each of the sidewalls 64 has an upper end 641 disposed between the pivot lugs 612, and a lower end 642. A pivot pin 92 extends through the pivot lugs 612 and the upper ends 641 of the sidewalls 64 along the left-to-right direction (Y), so as to connect an upper end of the rear link 62 pivotally to the support 2.

Each of the positioning grooves 65 is defined by a curved bottom surface 651, a stop surface 652 perpendicular to the bottom wall 63 and facing the lower end 642 of the corresponding sidewall 64, and an inclined guiding surface 653 inclined relative to the bottom wall 63, facing the upper end 641 of the corresponding sidewall 64, and connected to the stop surface 652 by the curved bottom surface 651.

The curved groove 66 in each of the sidewalls 64 is disposed between the lower end 642 and the positioning grooves 65 of the corresponding sidewall 64.

The front linking unit 70 includes a second pivot seat 71 disposed fixedly on the back plate 311 of the storage cabin housing 31, and a front link 72 connecting the rear link 62 pivotally to the second pivot seat 71.

The second pivot seat 71 includes a movable plate 711 connected fixedly to the back plate 312 of the storage cabin housing 32, and two parallel pivot lugs 712 extending perpendicularly from the movable plate 711.

The front link 72 has a U-shaped cross-section, and includes two sidewalls 74 and a connecting wall 73 connected between the sidewalls 74. Each of the sidewalls 74 has an upper end 741 disposed between the pivot lugs 712, and a lower end 742. A pivot pin 94 extends through the pivot lugs 712 and the upper ends 741 of the sidewalls 74 along the left-to-right direction (Y), such that an upper end of the front link 72 is connected pivotally to the mirror-mounting unit 3. A pivot pin 95 extends through the lower ends 742, 642 of the sidewalls 74, 64 of the front and rear links 72, 62, so as to allow for rotation of the front and rear links 72, 62 about the pivot pin 95. That is, Lower ends of the front and rear links 72, 62 are interconnected pivotally, so that the front and rear links 72, 62 cooperate with each other to constitute a linkage.

The positioning unit 80 includes a fixed shaft 81 disposed fixedly between the sidewalls 74 of the front link 72, a sliding member 82 disposed movably within the dovetail groove 67 in the rear link 62, a swing arm 83 connected between the fixed shaft 81 and the sliding member 82, an engaging member 84 configured as a horizontal rod disposed fixedly on the swing arm 83 and disposed movably within the sliding member 82, and a resilient member 85 disposed between the swing arm 83 and the pivot pin 95.

The sliding member 82 includes two parallel upright plate portions 821, two pairs of parallel transverse plate portions 821' extending respectively from the upright plate portions 821 away from each other and abutting respectively against the sidewalls 64 of the rear link 62, a connecting block 822 interconnecting the upright plate portions 821, and two L-shaped slide slots 823 formed respectively through the upright plate portions 821. Each of the slide slots 823 is generally L-shaped, and has a long slot section 824 extending in a direction parallel to the bottom wall 63, and has upper and lower portions 827, 828, and a short slot section 825 extending from the lower portion 828 toward the bottom wall 63.

The swing arm 83 has a pivot end 831 sleeved rotatably on the fixed shaft 81, and an engaging end 832 opposite to the pivot end 831.

The engaging member 84 extends through and is connected fixedly to the engaging end 832 of the swing arm 83, and extends through the slide slots 823 in the sliding member 82. When the engaging member 84 is in the long slot sections 824 of the slide slots 823, movement of the engaging member 84 into any one of the positioning grooves 65 in each of the sidewalls 64 of the rear link 62 is prevented. When the engaging member 84 is in the short slot sections 825 of the slide slots 823, movement of the engaging member 84 into a selected one of the positioning grooves 65 in each of the sidewalls 64 of the rear link 62 is allowed.

The resilient member 85 is configured as a tension spring, and has an upper end 851 hooked on an intermediate portion of the swing arm 83 adjacent to the pivot end 831, and a lower end 852 hooked on the pivot pin 95.

Figure 4:
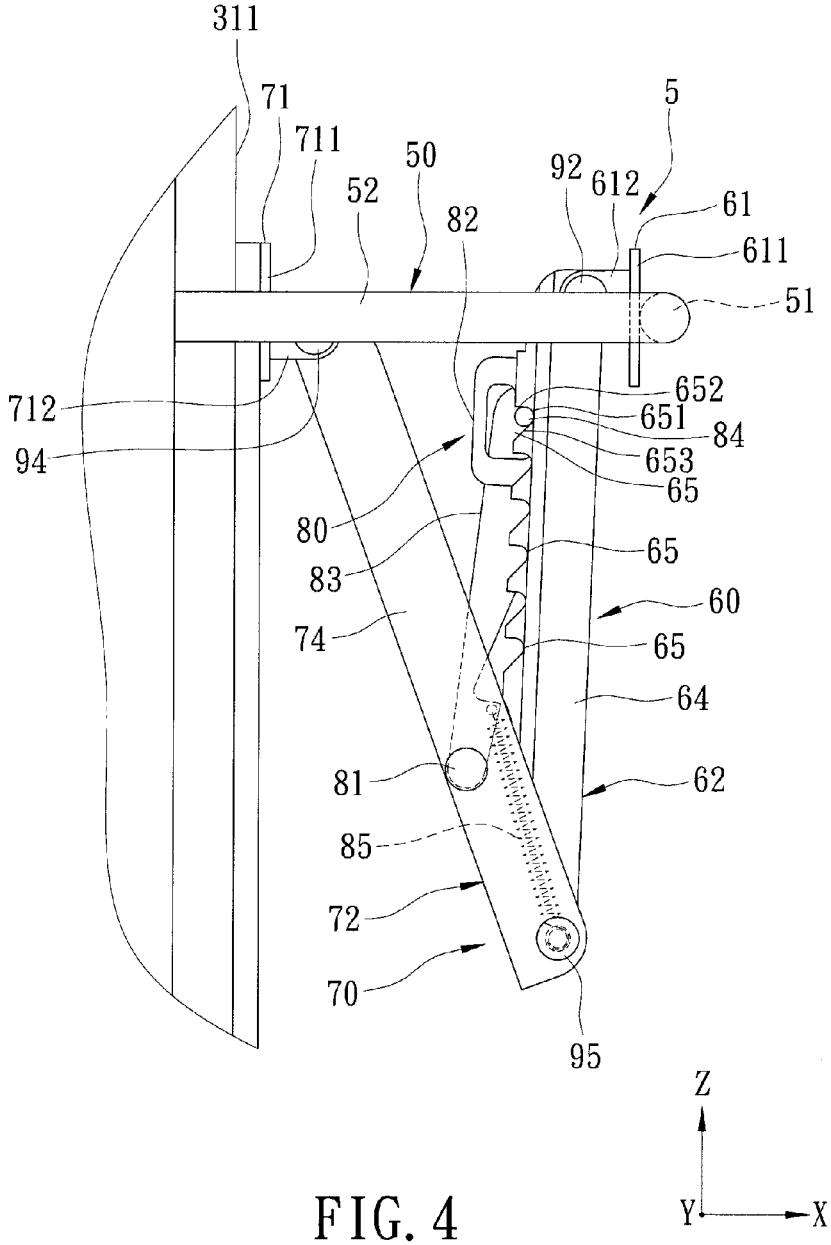
FIG. 4 is a fragmentary side view of the preferred embodiment, illustrating relative positions among a front link, a rear link, and an engaging member when the mirror-mounting unit is in the vertical position, where the engaging member is in an uppermost positioning groove unit.

During use, with particular reference to FIGS. 2, 3, and 4, when the mirror-mounting unit 3 is in a vertical position whereat it extends in an upright direction (Z) perpendicular to the front-to-rear direction (X) and the left-to-right direction (Y), the engaging member 84 is disposed in one of the positioning grooves 65 in each of the sidewalls 64 of the rear link 62 closest to the upper end of the rear link 62 (i.e., the uppermost positioning grooves 65). In this position, the resilient member 85 is stretched to store a return force, and a minimum maintainable angle is formed between the front and rear links 72, 62. Due to engagement between the engagement member 84 and the uppermost positioning grooves 65 and the return force of the resilient member 85, the mirror-mounting unit 3 is maintained in the vertical position. In this embodiment, the minimum maintainable angle is an acute angle.

Figure 9:
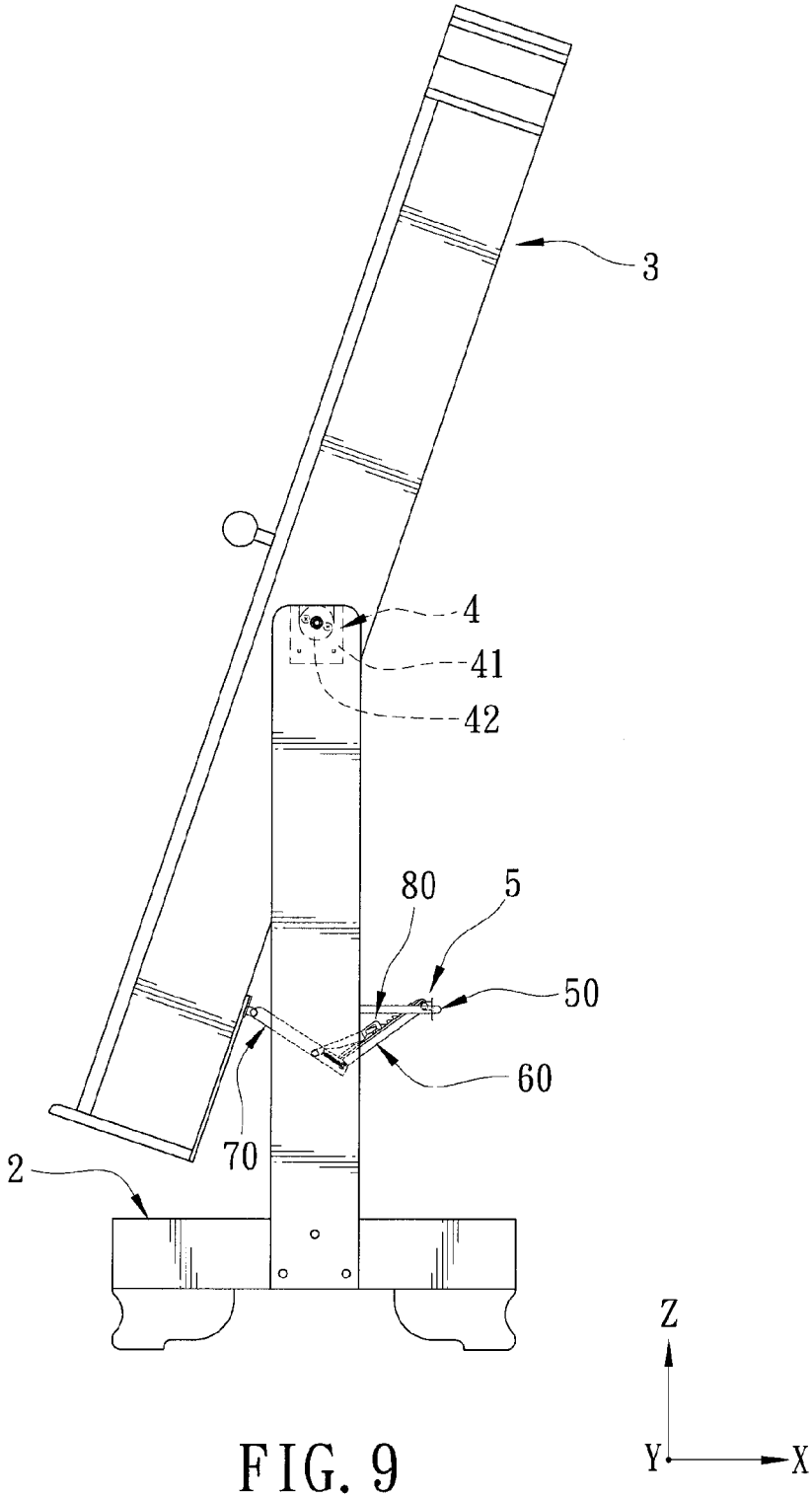
FIG. 9 is a view similar to FIG. 3 but illustrating an inclined position of the mirror-mounting unit.
Figure 10:
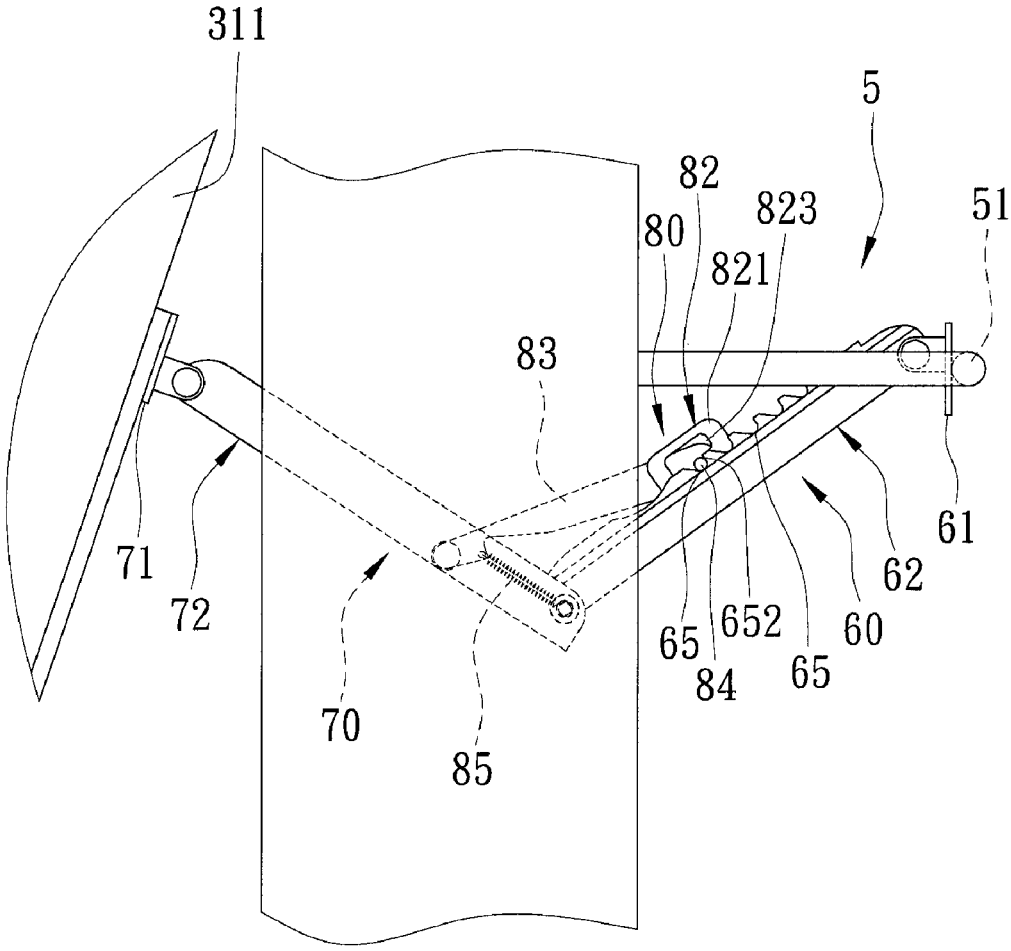
FIG. 10 is an enlarged view of a portion of FIG. 9, illustrating how the mirror-mounting unit is maintained in the inclined position.
Figure 11:
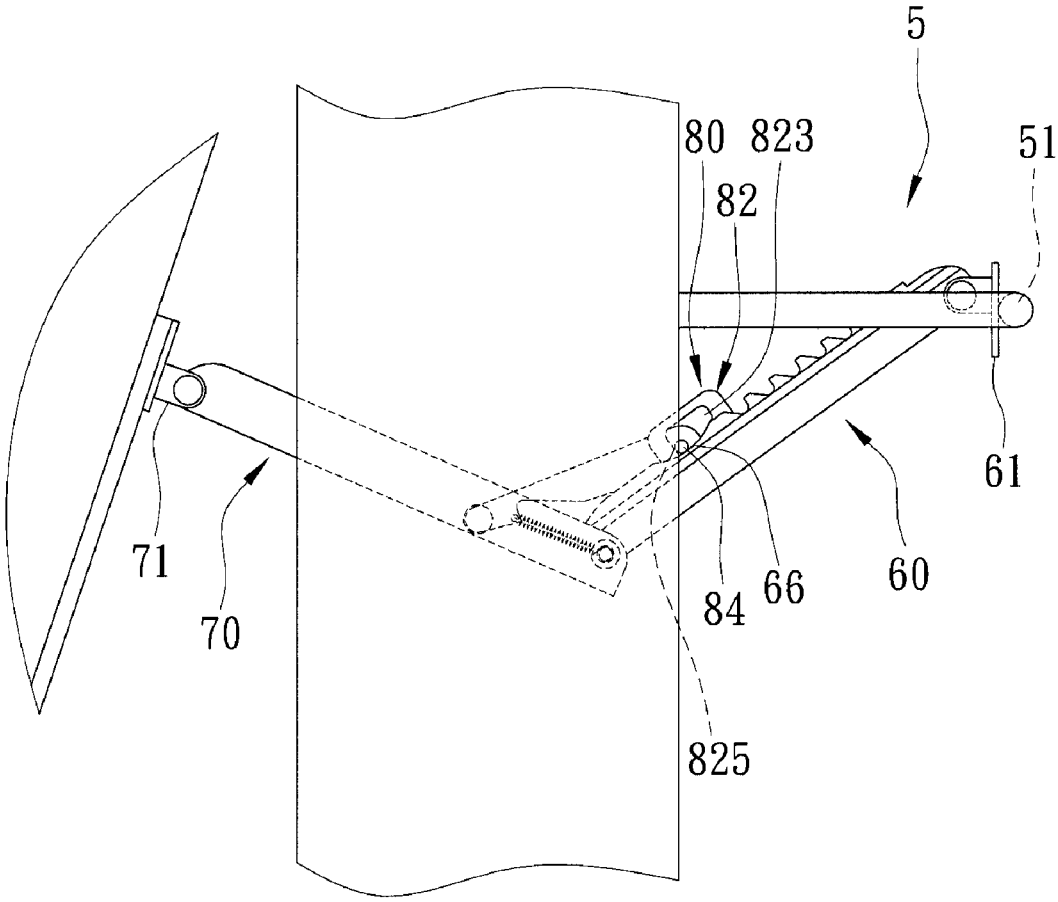
FIG. 11 is a view similar to FIG. 10 but illustrating that the engaging member is disposed in short slot sections of slide slots in the sliding member and curved grooves in the rear link.
Figure 12:
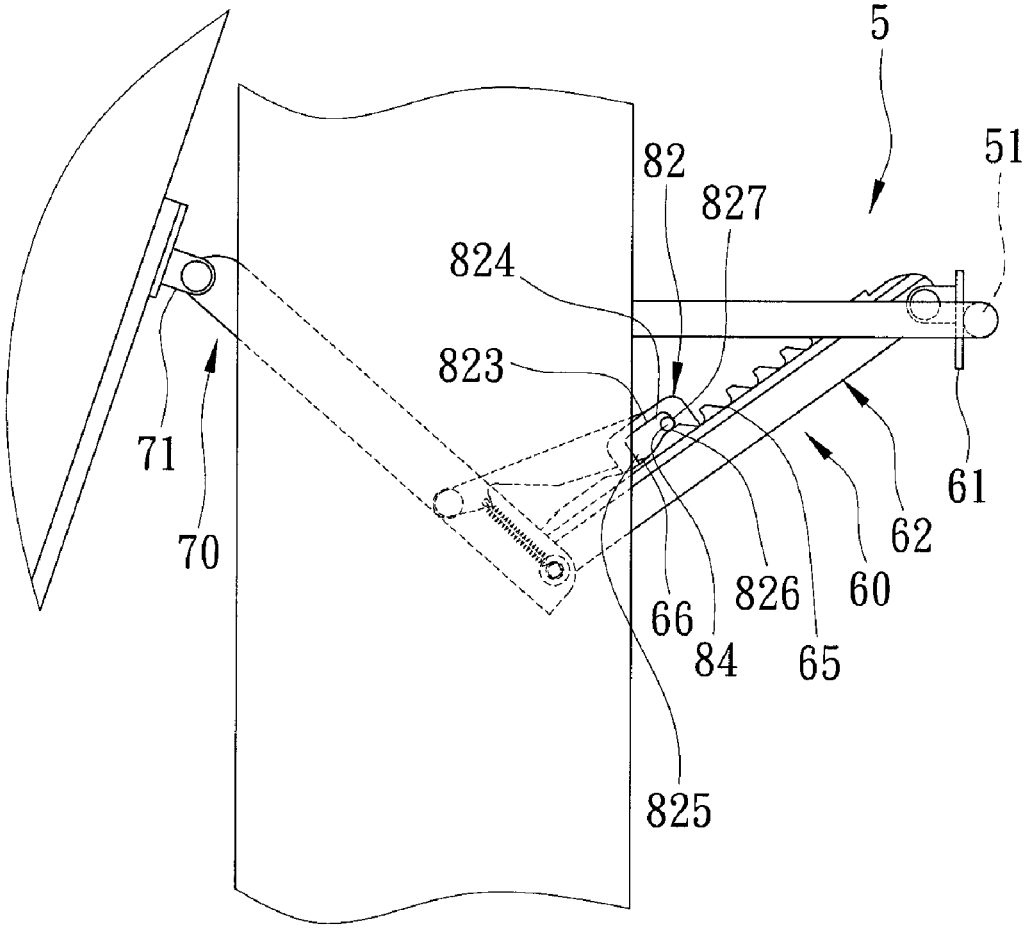
FIG. 12 is a view similar to FIG. 11 but illustrating that the engaging member is disposed in upper portions of long slot sections of the slide slots in the sliding member.

With particular reference to FIGS. 9 and 10, when it is desired to adjust the mirror-mounting unit 3 to a desired inclination angle, a force (e.g., pushing force) is applied to pivot the upper end of the mirror-mounting unit 3 rearwardly to move the sliding member 82 toward the lower end of the rear link 62. During rearward pivoting movement of the upper end of the mirror-mounting unit 3, since the engaging member 84 is disposed in the lower portions 828 of the long slot sections 824 in the slide slots 823, when the mirror-mounting unit 3 is pivoted to the desired inclination angle, as long as the pushing force is released, the engaging member 84 is biased by the resilient member 85 into the short slot sections 825 and an aligned pair of the positioning grooves 65 corresponding to the desired inclination angle. It should be noted that, with the assistance of the resilient member 85, the pushing force required to pivot the upper end of the mirror-mounting unit 3 rearwardly can be reduced considerably. In other words, the upper end of the mirror-mounting unit 3 is easy to pivot rearwardly. When the engaging member 84 is disposed in the lowermost positioning grooves 65, a maximum maintainable angle is formed between the front and rear links 72, 62, and the mirror-mounting unit 3 is disposed in an inclined position, and at a maximum maintainable inclination angle. In this embodiment, the maximum maintainable angle is an obtuse angle.

With particular reference to FIGS. 2, 7, 11, and 12, when return of the mirror-mounting unit 3 from the inclined position to the vertical position is desired, it is necessary to first proceed to pivot the upper end of the mirror-mounting unit 3 rearwardly so as to move the engaging member 84 into the curved grooves 66 in the sidewalls 64 of the rear link 62. Next, the upper end of the mirror-mounting unit 3 is pivoted forwardly to move the engaging member 84 from the curved grooves 66 toward the positioning grooves 65. When removed from the curved grooves 66, the engaging member 84 moves from the short slot portions 825 into the lower portions 828 of the slide slots 823 and, thus, the upper portions 827 of the slide slots 823. Hence, the engaging member 84 pushes and moves the sliding member 82 toward the upper end of the rear link 62. During movement of the sliding member 82 toward the upper end of the rear link 62, since the engaging member 84 is disposed in the upper portions 827 of the slide slots 823, movement thereof into any one of the positioning grooves 65 can be prevented. When the mirror-mounting unit 3 is pivoted to the vertical position, the sliding member 82 comes into contact with the pivot pin 92. At this time, the mirror-mounting unit 3 is released, so as to allow the engaging member 84 to be biased by the resilient member 85 to move from the upper portions 827 of the slide slots 823 into the lower portions 828 and, thus, the short slot sections 825 and the uppermost positioning grooves 65 in the rear link 62, thereby maintaining the mirror-mounting unit 3 in the vertical position.

In an alternative embodiment, the positioning groove units are formed in the front link 72, and the pivot end 831 of the swing arm 83 is connected pivotally to the rear link 62.

With this invention thus explained, it is apparent that numerous modifications and variations can be made without departing from the scope and spirit of this invention. It is therefore intended that this invention be limited only as indicated by the appended claims.

I claim:

1. An adjustable dressing mirror assembly comprising:

a support including a base and two upright rods disposed fixedly on and above said base;

a mirror-mounting unit disposed rotatably between said upright rods of said support in such a manner to allow for forward and rearward pivoting movement of an upper end of said mirror-mounting unit relative to said support;

a mirror disposed on said mirror-mounting unit;

a linkage including a rear link having an upper end connected pivotally to said support, and a lower end, and a front link having an upper end connected pivotally to said mirror-mounting unit, and a lower end connected pivotally to said lower end of said rear link; and a positioning device including a plurality of positioning groove units formed in one of said front and rear links and arranged along a longitudinal direction of the one of said front and rear links, a swing arm having a pivot end connected pivotally to the other one of said front and rear links, and an engaging end opposite to said pivot end, an engaging member disposed on said engaging end of said swing arm such that, by rotating said mirror-mounting unit relative to said support, said engaging member is movable to engage within a selected one of said positioning groove units, and a resilient member for biasing said engaging member into the selected one of said positioning groove units.

2. The adjustable dressing mirror assembly as claimed in claim 1, wherein:

said positioning groove units in said positioning device are formed in said rear link;

said pivot end of said swing arm is connected pivotally to said front link; and said linkage further includes a pivot pin interconnecting said lower ends of said front and rear links.

3. The adjustable dressing mirror assembly as claimed in claim 2, wherein:

said rear link includes a bottom wall and two aligned sidewalls extending respectively from two opposite sides of said bottom wall, each of said sidewalls being serrated and having a plurality of positioning grooves, said positioning grooves of said sidewalls constituting said positioning groove units;

said swing arm is configured as an upright plate, said engaging end of said swing arm being disposed between said sidewalls of said rear link; and said engaging member is configured as a rod, extends through said engaging end of said swing arm, and engages a selected one of said positioning grooves in each of said sidewalls of said rear link.

4. The adjustable dressing mirror assembly as claimed in claim 3, wherein:

a distance between said sidewalls reduces in a direction away from said bottom wall, such that a dovetail groove is defined among said bottom wall and said sidewalls;

said positioning device further includes a sliding member that is disposed movably within said dovetail groove and that is shaped so as to prevent upward removal of said sliding member from said dovetail, said sliding member having at least one slide slot formed therethrough; and said engaging member extending movably through said slide slot in said sliding member.

5. The adjustable dressing mirror assembly as claimed in claim 4, wherein:

When said mirror-mounting unit is in a vertical position, said engaging member is disposed in one of said positioning grooves in each of said sidewalls closest to said upper end of said rear link;

each of said sidewalls of said rear link further has a curved groove disposed between said lower end of said rear link and said positioning grooves and aligned with said positioning grooves along a direction parallel to said bottom wall, each of said positioning grooves being defined by an inclined guiding surface inclined relative to said bottom wall and facing said upper end of said rear link, a stop surface perpendicular to said bottom wall and facing said lower end of said rear link, and a bottom surface interconnecting said inclined guiding surface and said stop surface; and said slide slot in said sliding member is generally L-shaped, and has a long slot section extending in a direction parallel to said bottom wall, having interconnected upper and lower portions, and positioned such that, when said engaging member is disposed in said long slot section, movement of said engaging member into any one of said positioning grooves is prevented, and a short slot section that extends from said lower portion of said long slot section toward said bottom wall and that is positioned such that, when said engaging member is disposed in said short slot section, movement of said engaging member into the selected one of said positioning grooves is allowed, so that, when a pushing force is applied to pivot said upper end of said mirror-mounting unit rearwardly from a position whereat said mirror-mounting unit is in said vertical position, so as to move said sliding member toward said lower end of said rear link, said engaging member can be biased by said resilient member into the selected one of said positioning groove units as long as the pushing force is released, and when said upper end of said mirror-mounting unit is pivoted forwardly to move said engaging member from said curved grooves in said sidewalls toward said positioning groove units, said engaging member moves into said upper portion of said long slot section of said slide slot in said sliding member so as to push said sliding member toward said upper end of said rear link, thereby preventing movement of said engaging member into any one of said positioning groove units until said mirror-mounting unit is pivoted to said vertical position.

6. The adjustable dressing mirror assembly as claimed in claim 2, wherein said resilient member is configured as a tension spring and having an upper end connected to an intermediate portion of said swing arm, and a lower end connected to said pivot pin.

* * * * *